US011744328B1

(12) United States Patent
Chen et al.

(10) Patent No.: US 11,744,328 B1
(45) Date of Patent: Sep. 5, 2023

(54) TIGHTNESS ADJUSTING DEVICE FOR SHOESLACES

(71) Applicant: SHOES-LOCK SPORTS EQUIPMENT CO., LTD., Fujian (CN)

(72) Inventors: Liyong Chen, Fujian (CN); Qiuyun Liang, Fujian (CN); Zhiliang Yao, Fujian (CN)

(73) Assignee: SHOES-LOCK SPORTS EQUIPMENT CO., LTD., Fujian (CN)

( * ) Notice: Subject to any disclaimer, the term of this patent is extended or adjusted under 35 U.S.C. 154(b) by 0 days.

(21) Appl. No.: 18/117,004

(22) Filed: Mar. 3, 2023

Related U.S. Application Data

(63) Continuation of application No. PCT/CN2023/074075, filed on Feb. 1, 2023.

(51) Int. Cl.
*A43C 7/08* (2006.01)

(52) U.S. Cl.
CPC ..... *A43C 7/08* (2013.01)

(58) Field of Classification Search
CPC ..... A43C 7/08; A43C 11/008; A43C 11/12; A43C 7/00; Y10T 24/3713; Y10T 24/3703
See application file for complete search history.

(56) References Cited

U.S. PATENT DOCUMENTS 6,966,102 B2 * 11/2005 Shiue ..... A43C 11/14 24/194
7,036,193 B1 * 5/2006 Liu ..... A43C 7/08 24/712.1
7,313,849 B2 * 1/2008 Liu ..... A43C 11/24 24/712.1
7,657,980 B2 * 2/2010 Liu ..... A43C 7/08 24/712.1
7,681,289 B2 * 3/2010 Liu ..... A43C 7/08 24/712.1
8,371,004 B2 * 2/2013 Huber ..... A43B 5/0401 24/712.1

(Continued)

FOREIGN PATENT DOCUMENTS

CN 113545563 A 10/2021

*Primary Examiner* — Robert Sandy
*Assistant Examiner* — Louis A Mercado
(74) *Attorney, Agent, or Firm* — COOPER LEGAL GROUP, LLC

(57) ABSTRACT

The present application relates to a tightness adjusting device for shoelaces, which includes a connection mechanism and a traction mechanism. The traction mechanism includes a traction assembly, the traction assembly includes a ring member hinged with the connection mechanism, the traction mechanism further includes an elastic adjusting assembly; the elastic adjusting assembly includes a connection block, a clamping block, an elastic member and a linkage member, a connection portion is connected to each end of the connection blocks, the connection portion is detachably connected to the ring member, the connection block divides the ring member into two shoelace holes, the clamping block is hinged with the connection block, the elastic member is configured to force the two clamping blocks away from each other, and to mount the shoelaces in the shoelace holes with the ring member, the clamping block is connected to the connection portion by the linkage member.

10 Claims, 12 Drawing Sheets

(56) References Cited

U.S. PATENT DOCUMENTS

| | | | | |
|---|---|---|---|---|
| 8,499,424 | B2 * | 8/2013 | Chen | A43C 7/04 24/712.7 |
| 9,427,045 | B1 * | 8/2016 | Hannon | A43C 7/00 |
| 11,278,084 | B2 * | 3/2022 | Spinelli | A43C 1/06 |
| 2006/0168784 | A1 * | 8/2006 | Ahn | A43C 11/00 24/712.5 |
| 2009/0193634 | A1 * | 8/2009 | Liu | A43C 11/24 24/712.5 |
| 2009/0205175 | A1 * | 8/2009 | Han | A43B 3/0078 24/712.1 |
| 2011/0302752 | A1 * | 12/2011 | Liu | A43C 7/08 24/713.3 |

* cited by examiner

A

B

TIGHTNESS ADJUSTING DEVICE FOR SHOESLACES

CROSS-REFERENCE TO RELATED APPLICATION

This application is a continuation of PCT application serial no. PCT/CN2023/074075, filed on Feb. 1, 2023. The entirety of PCT application serial no. PCT/CN2023/074075 is hereby incorporated by reference herein and made a part of this specification.

TECHNICAL FIELD

The present application relates to a field of accessories for shoes and in particular, relates to a tightness adjusting device for shoelaces.

BACKGROUND ART

Shoelaces are used to adjust the tightness of shoes, and two ends of each shoelace are generally fixed by knotting a slipknot. When wearing the shoes in practice, the slipknot of the shoelace is easy to loosen or form a fast knot, which influences the tightness adjustment of the shoelace.

Chinese patent application no. CN113545563A discloses a tightness adjusting device for shoelaces, which includes a connection mechanism, a traction mechanism and a lifting belt, in which the traction mechanism is connected to the connection mechanism. The traction mechanism includes a traction assembly and a sliding assembly. There are two traction assemblies, each traction assembly includes a ring member, and the ring member is hinged with the connection mechanism. The sliding assembly includes a sliding member and an elastic pushing member. Each ring member is provided with the sliding member, and the ring member penetrates the sliding member, so that the sliding member divides the ring member into two shoelace holes for shoelaces. The elastic pushing member is mounted in the sliding member, and is located in the ring member. The elastic pushing member is faced toward two shoelace holes under an undeformed state. The elastic pushing member is configured to clamp the shoelaces in the shoelace hole in coordination with the ring member. The lifting belt is connected to the connection mechanism and penetrates the ring member. The lifting belt is configured to drive the traction assembly to slide.

When loosening the shoes by shoelaces, the lifting belt is pulled towards the direction away from the shoes, and the whole tightness adjusting device is moved towards the end of the shoelace, so as to adjust the tightness of the shoelaces. When tightening the shoes by shoelaces, two lifting belts connected to the traction assemblies are pulled away from each other, so that two traction assemblies tend to be located in the same plane with the connection base. Then the flexible end of the shoelace is pulled to tighten the shoes.

The lifting belt and traction mechanism are convenient for adjusting the tightness of shoelaces. However, the shoelaces are required to pass through two shoelace holes of the ring member when mounting the shoelaces in the traction mechanism. There are two ring members, which means each shoelace is required to pass through four shoelace holes. It is also required to adjust the length of the shoelaces where two ends of the shoelaces pass through the shoelaces, so as to reduce the situation that the parts of the shoelaces exposed to the traction mechanism have different lengths, influencing the appearance. The operation of mounting the shoelaces in the tightness adjusting device is complicate and has a low efficiency.

SUMMARY

In order to simplify the operation of mounting the shoelaces in the tightness adjusting device, the present application provides a tightness adjusting device for shoelaces.

The tightness adjusting device for shoelaces provided in the present application adopts the following technical solution.

A tightness adjusting device for shoelaces includes a connection mechanism and a traction mechanism, in which the traction mechanism includes a traction assembly, the traction assembly includes a ring member hinged with the connection mechanism, the traction mechanism further includes an elastic adjusting assembly;

the elastic adjusting assembly includes a connection block, a clamping block, an elastic member and a linkage member, a connection portion is connected to each of two ends of the connection block, the connection portion is detachably connected to the ring member, the connection block divides the ring member into two shoelace holes for accommodating shoelaces, there are two clamping blocks, each clamping block is hinged with the connection block, the elastic member is connected among the connection block and the clamping blocks, the elastic member is configured to force the two clamping blocks away from each other, and to mount the shoelaces in the shoelace holes with the ring member, the clamping block is connected to the connection portion by the linkage member, when two clamping blocks are abutted against each other, the connection portion is detach from the ring member by the linkage member.

In the above technical solution, before mounting the shoelaces in the traction mechanism, two clamping blocks are forced to abut against each other, and the shoelace is placed on the connection block. After the exposed length of the shoelace is determined, the connection block is connected to the ring member by the connection portion, so as to make the shoelace pass through two shoelace holes. In addition, the exposed length of the shoelace is determined before the shoelace passes through the shoelace holes. The shoelace can be settled in one step when mounting the tightness adjusting device on the shoelace in the factory or by the customer, which improves the factory assembly efficiency and using experience of the customers. It is convenient for the customer to wash the shoelace or replace the shoelace that passes through the traction assembly, simplifying the operation of mounting the shoelace in the tightness adjusting device. Further, the shoelace is clamped by the clamping block and the ring member using the elastic member. Since the clamping block is hinged with the connection block, there is an angel between two clamping blocks when clamping the shoelace, so as to reduce the movement possibility of the shoelace in the shoelace hole due to the shaking of feet in the daily life and improve the connection stability between the shoelace and the tightness adjusting device.

In some embodiments, the connection portion includes an inserting block and a first spring, the inserting block is slidably connected to an end of the connection block, a mounting chamber is provided in the connection block, the first spring is mounted in the mounting chamber, an end of the first spring abuts against a portion of the inserting block that is located in the mounting chamber to force the inserting block away from the mounting chamber, an inserting hole is provided on a sidewall of the ring member, the inserting block is configured to insert in the inserting hole.

In the above technical solution, the inserting block and the inserting hole can realize a detachable connection between the connection portion and the ring member, reducing the risk that the connection portion is disengaged from the ring member in the daily sport, and increasing the connection strength between the connection portion and the ring member. In addition, the mounting chamber facilitates the installation of the first spring, so that the appearance of the connection block is clean and beautiful.

In some embodiments, the linkage member includes an elastic plate and a connection cord, an end of the elastic plate is connected to one clamping block and the other end thereof is connected to the other clamping block bypassing the connection block, the elastic plate is connected to the inserting block by the connection cord, when two clamping blocks are abutted against each other, the elastic plate is deformed to protrude, and the inserting block is disengaged from the inserting hole by a pull force of the connection cord.

In the above technical solution, in one aspect, the elastic further increases the elastic force of the elastic member, increasing the difficulty that two clamping blocks abut against each other, reducing the risk that the shoelace is disengaged from the ring member in the daily sport. In another aspect, the protruded deformation of the elastic plate in combination with the pull of the connection cord realize that the inserting block is disengaged from the inserting hole, so that the connection portion is detached from the ring member.

In some embodiments, the linkage member includes an abutting rod and a trigger plate, the abutting rod is provided in the clamping block, an end of the abutting rod away from the clamping block is configured to abut against the trigger plate, the trigger plate is slidably connected to the connection block, a moving direction of the trigger plate is perpendicular to a moving direction of the inserting block, a moving hole is provided on a sidewall of the connection block, a part of the trigger plate protrudes out of the moving hole, a first guiding block is provided in a part of the inserting block that is located in the mounting chamber, a second guiding block is provided in a part of the trigger plate that is located in the mounting chamber, the second guiding block is configured to abut against the first guiding block, when two clamping blocks abut against each other, the abutting rod abuts against a part of the trigger plate that protrudes out of the mounting chamber, and drives the trigger plate to move, the trigger plate forces the inserting block disengaging from the ring member by the first guiding block and the second guiding block.

In the above technical solution, by using the displacement of two clamping blocks when two clamping blocks are abutted against each other and combining with the abutting rod, the trigger plate can force the inserting block disengaging from the ring member by the first guiding block and the second guiding block, reducing the risk that the inserting block cannot be disengaged from the ring member due to the entrance of the external impurities in the inserting hole. Further, the trigger plate can be directly pressed, so that the inserting block is directly disengaged from the ring member without pinching two clamping blocks, providing a redundant design for the disengagement of the inserting block from the ring member, and ensuring the disengagement of the inserting block from the ring member.

In some embodiments, a limiting hole for the trigger plate to pass through is provided on the sidewall of the connection block, the limiting hole is corresponding to the moving hole, a limiting member is detachably connected to the connection block, the limiting member is configured to block the limiting hole and limit the movement of the trigger plate.

In the above technical solution, the limiting hole and the limiting member provide an insurance for the disengagement of the inserting block from the ring member. The limiting member is moved only when the inserting block is required to disengaged from the ring member. The limiting member limits the inserting block disengaging from the ring member by the first guiding block and the second guiding block in the rest of time, improving the connection strength between the inserting block and the ring member.

In some embodiments, the limiting member includes a second spring and a plugging block, two ends of the second spring are sleeved around a periphery of the ring member, the plugging block is mounted in the middle of the second spring, the second spring is configured to force the plugging block inserting in the limiting hole.

In the above technical solution, the second spring and the plugging block realize the limiting member can adaptively plug in or disengage from limiting hole without manual movement of the limiting member when mounting the connection block in the ring member, improving the efficiency of mounting the shoelace in the traction mechanism.

In some embodiments, a notch is provided on a periphery of the ring member, the notch is communicated with the inserting hole, an internal wall of the ring member corresponding to the notch is configured to be inclined to form a sliding surface for guiding the inserting block inserting into the inserting hole.

In the above technical solution, the efficiency that inserting the inserting block in the inserting hole is improved in the situation of a restricted view.

In some embodiments, a groove is provided in a periphery of the connection block, the groove is provided along the circumference of the connection block for accommodating the shoelace.

In the above technical solution, the design of the groove can reduce the risk that the shoelace slides on the connection block. The shoelace can temporarily and stably stay on the periphery of the connecting block when mounting the connection block in the ring member. Further, the design of the groove narrows a part of the mounting chamber of the connection block, so as to reduce the risk of the excessive deformation and displacement of the spring in the mounting chamber.

In some embodiments, a swing rod is hinged with the connection mechanism, a sharp pin is provided on a periphery of the swing rod, the sharp pin is configured to pierce the shoelace, a lifting belt connected to the swing rod is provided in the connection mechanism, the lifting belt is configured to lift the traction assembly, when two traction assemblies are on a same plane, the lifting belt lift the swing rod to disengage from the shoelace, so that the sharp pin is disengaged from the shoelace.

In the above technical solution, the swing rod and the sharp pin realize stabilizing the position of the shoelace in the shoelace holes. When adjusting the tightness of the shoelace, two traction assemblies are moved to the same plane by using the lifting belt, so that the sharp pin can be disengaged from the shoelace, and the tightness can be adjusted by pulling the shoelace.

In some embodiments, a weight block is provided in the swing rod, and the weight block is configured to force the sharp pin piercing the shoelace.

In the above technical solution, the sharp pin keeps in the state of piercing the shoelace in a normal state, which is influenced by the gravity of the weight block, further reducing the risk that the shoelace is disengaged from the traction mechanism in daily sport.

In summary, the present application includes at least one of the following beneficial effects:

1. By providing the connection block and two clamping blocks, two clamping blocks are forced to abut against each other, and the shoelace is placed on the connection block. After the exposed length of the shoelace is determined, the connection block is connected to the ring member by the connection portion, so as to make the shoelace pass through two shoelace holes. In addition, the exposed length of the shoelace is determined before the shoelace passes through the shoelace holes, which improves the factory assembly efficiency and using experience of the customers. It is convenient for the customer to wash the shoelace or replace the shoelace that passes through the traction assembly, simplifying the operation of mounting the shoelace in the tightness adjusting device.
2. In one aspect, the elastic further increases the elastic force of the elastic member, increasing the difficulty that two clamping blocks abut against each other, reducing the risk that the shoelace is disengaged from the ring member in the daily sport. In another aspect, the protruded deformation of the elastic plate in combination with the pull of the connection cord realize that the inserting block is disengaged from the inserting hole, so that the connection portion is detached from the ring member.
3. The trigger plate and the abutting rod are provided. By using the displacement of two clamping blocks when two clamping blocks are abutted against each other and combining with the abutting rod, the trigger plate can force the inserting block disengaging from the ring member by the first guiding block and the second guiding block, reducing the risk that the inserting block cannot be disengaged from the ring member due to the entrance of the external impurities in the inserting hole. Further, the trigger plate can be directly pressed, so that the inserting block is directly disengaged from the ring member without pinching two clamping blocks, providing a redundant design for the disengagement of the inserting block from the ring member, and ensuring the disengagement of the inserting block from the ring member.

DETAILED DESCRIPTION

The present application is further described in detail below in combination with FIGS. 1-12.

The embodiment of the present application discloses a tightness adjusting device for shoelaces, which is intended to simplify the operation of mounting the shoelace in the tightness adjusting device.

Embodiment 1

Figure 1:
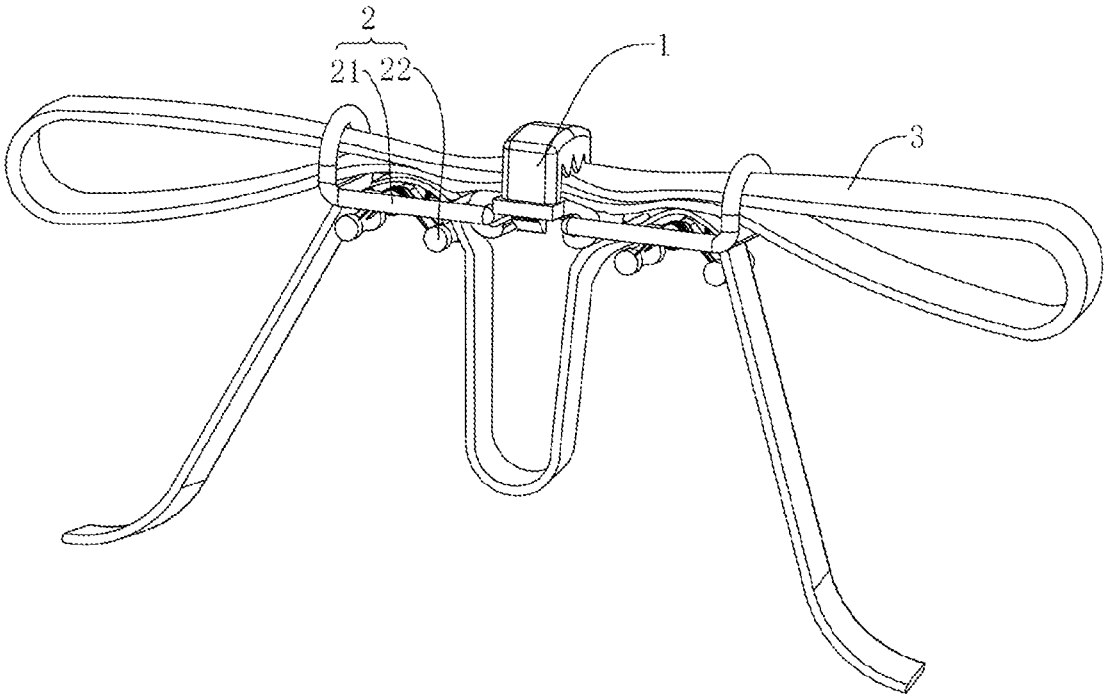
FIG. 1 is a schematic diagram for indicating a state that shoelace is mounted in a traction assembly in Embodiment 1.

Referring to FIG. 1, a tightness adjusting device for shoelaces includes a connection mechanism 1 and a traction mechanism 2. The traction mechanism 2 is hinged with the connection mechanism 1. The shoelace is mounted in the traction mechanism 2. The traction mechanism 2 clamps the shoelace. The tightness adjustment of the shoelace can be realized by moving the traction mechanism 2.

Figure 2:
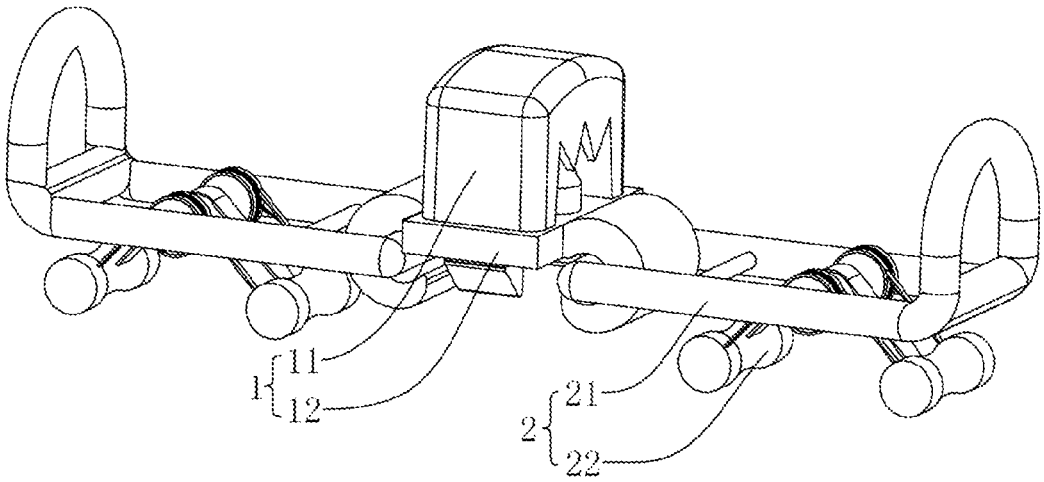
FIG. 2 is a schematic diagram for indicating an overall structure in Embodiment 1.
Figure 3:
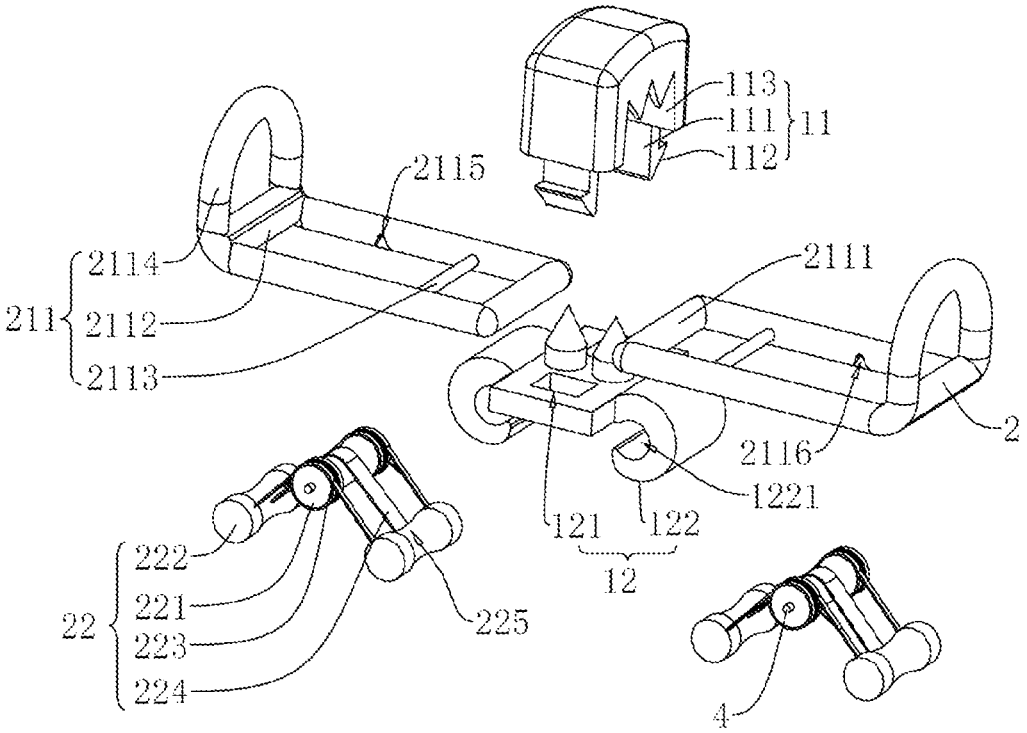
FIG. 3 is a schematic diagram for indicating an exploded structure in Embodiment 1.

Referring to FIG. 2 and FIG. 3, the connection mechanism 1 includes a fixed cover 11 and a connection base 12. Two snapping blocks 111 are provided on a lower side of the fixed cover 11. Two snapping blocks 111 are symmetrically arranged on two sides of the fixed cover 11 respectively. Snapping holes 121 for accommodating the snapping blocks 111 are provided in the middle of the connection base 12. A hook 112 is provided on a side of each snapping block 111 away from the other snapping block 111. A bevel for facilitating passing through the snapping hole 121 is provided on an end of the hook 112 away from the fixed cover 11. The snap-in connection between the fixed cover 11 and the connection base 12 are realized by the snapping block 111 and the snapping hole 121.

Referring to FIG. 1 and FIG. 3, a through hole 113 is provided on a sidewall of the fixed cover 11. A lifting belt 3 passing through the through hole 113 is provided in the fixed cover 11. Two ends of the lifting belt 3 pass through the traction mechanism 2. Two hinging blocks 122 are provided on two corresponding sides of the connection base 12 respectively. A hinging groove 1221 is provided in each hinging block 122. The traction mechanism 2 is hinged with the connection base 12 through the hinging groove 1221. The hinging groove 1221 is positioned in the lower part of the connection base 12. The openings of two hinging grooves 1221 are oppositely arranged. Two ends of the lifting belt 3 are lifted in use to control the rotation angle of the traction mechanism 2. Then the shoelace is pulled to realize adjusting the tightness of the shoelace.

There are two traction mechanisms 2 in the present application and the two traction mechanisms 2 are correspondingly arranged. Each traction mechanism 2 includes a traction assembly 21 and an elastic adjusting assembly 22. The traction assembly 21 includes a ring member 211. A traction snapping rod 2111 is provided in the ring member 211. The traction snapping rod 2111 is placed in the opening of the hinging groove 1221 through the gap between two hinging blocks 122, so that the traction snapping rod 2111 is snapped in the hinging groove 1221 to form a hinged connection with the hinging block 122. A partition rod 2112 is provided on a side of the ring member 211 away from the traction snapping rod 2111, and a limiting rod 2113 is provided in the ring member 211. There is a gap between the limiting rod 2113 and the traction snapping rod 2111. A connection gap is formed in the ring member 211 between the partition rod 2112 and the limiting rod 2113. The elastic adjusting assembly 22 is positioned in the connection gap. A traction ring member 2114 is connected to a side of the ring member 211 close to the partition rod 2112. The traction ring member 2114 is positioned above the partition rod 2112. A traction hole for the end of the lifting belt 3 to pass through is provided in the traction ring member 2114.

The ring member 211 is detachably connected to the corresponding elastic adjusting assembly 22. When mounting the shoelace in the traction mechanism 2, the shoelace is placed on the elastic adjusting assembly 22, and the elastic adjusting assembly 22 is connected to the ring member 211, so as to finish the action of mounting the shoelace in the traction mechanism 2.

The elastic adjusting assembly 22 includes a connection block 221, a clamping block 222, an elastic member 223 and a linkage member 224. The connection block 221 and the clamping block 222 both have a cylinder structure. Grooves 225 are respectively provided on the peripheries of the connection blocks 221 and the clamping block 222. The groove 225 is arranged along the circumference of the cylinder structure. The groove 225 is configured for accommodating the shoelace. The connection block 221 is positioned between the partition rod 2112 and the limiting rod 2113, the connection block 221 and the clamping block 222 can both pass through the connection gap. A connection portion 4 is movably connected to each of the two ends of the connection block 221. The connection portion 4 is detachably connected to the ring member 211. The connection block 221 divides the connection gap into two shoelace holes for shoelace to pass through. The movable connection between the connection portion 4 and the connection block 221 can be a slidable connection, a snap-in connection or a clamping connection. In the embodiment of the present application, the connection portion 4 is slidably connected to an end of the connection block 221.

There are two clamping blocks 222. Two clamping blocks 222 are both hinged with the periphery of the connection block 221. The elastic member 223 is connected between the connection block 221 and the clamping block 222. The elastic member 223 is configured to force two clamping blocks away from each other, to clamp the shoelace in the shoelace holes in combination with the ring member 211. That is, one end of the shoelace abuts against the partition rod 2112 by one clamping block 222, and the other end of the shoelace abuts against the limiting rod 2113 by the other clamping block 222. In this embodiment, the elastic member 223 adopts a torsion spring. In some other embodiments, the elastic member 223 can adopt a tension spring. One end of the tension spring is connected to one clamping block 222, and the other end thereof is connected to the other clamping block 222 bypassing the connection block 221. The elastic member 223 is not limited in the present application, as long as the elastic member 223 can force two clamping blocks 222 away from each other.

Figure 4:
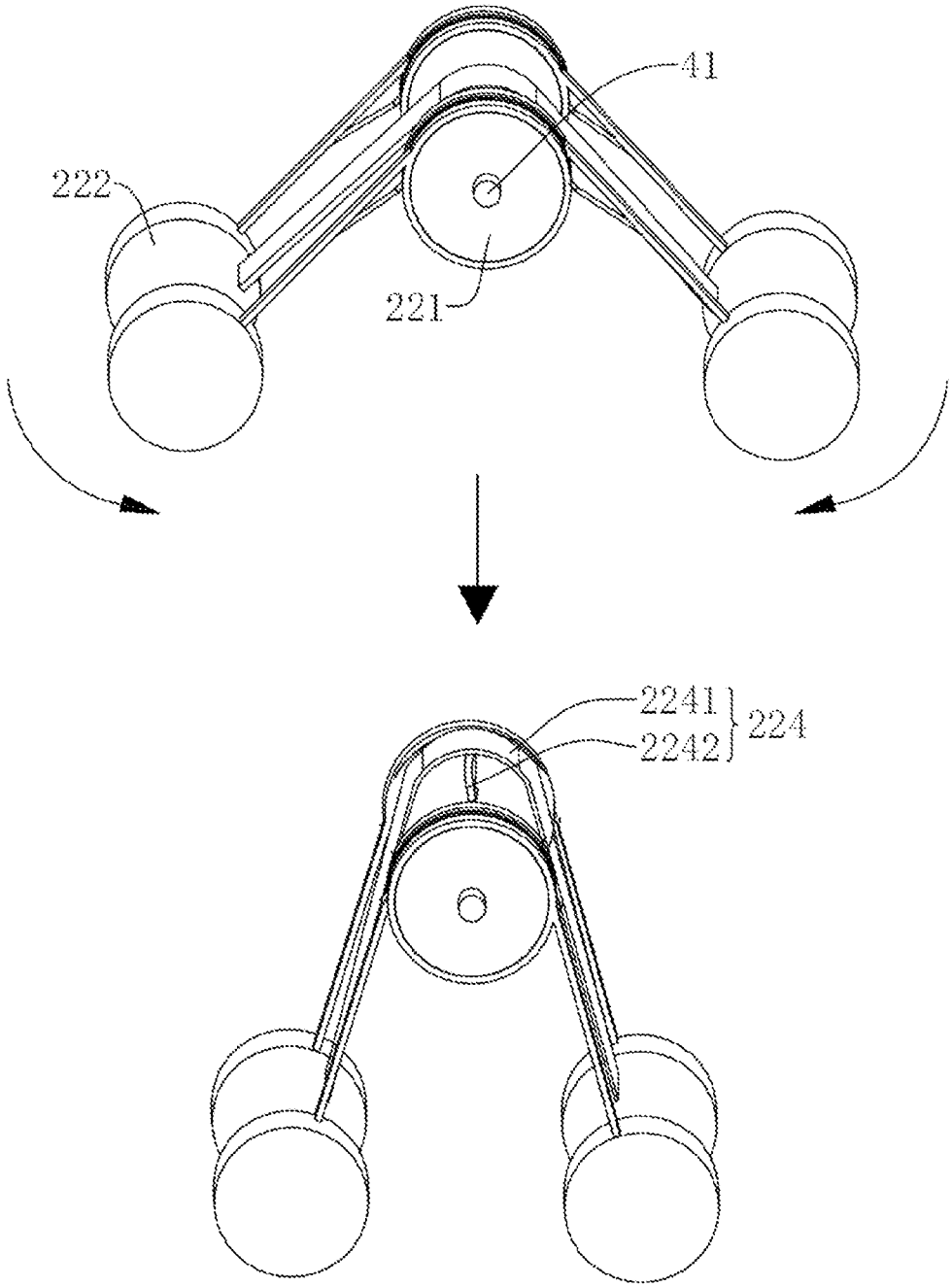
FIG. 4 is a dynamic schematic diagram for indicating a linkage member in a state of pinching two clamping blocks in Embodiment 1.

Referring to FIG. 3 and FIG. 4, the clamping block 222 is connected to the connection portion 4 by the linkage member 224. When pinching two clamping blocks 222 to abut against each other, the linkage member 224 force the connection portion 4 disengaging from the ring member, so that the shoelace is disengaged from the traction mechanism 2 by pinching two clamping blocks 222.

Figure 5:
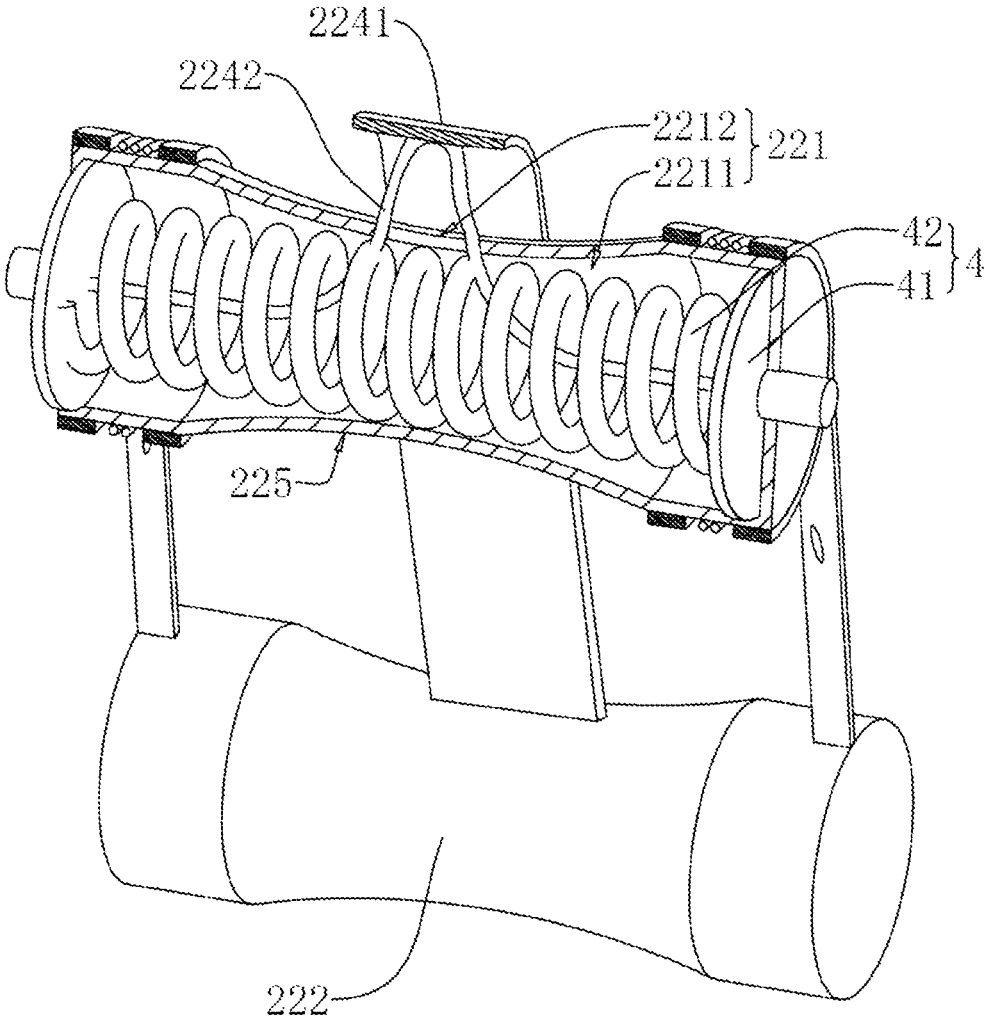
FIG. 5 is a structural schematic diagram for indicating a connection block and a linkage member in Embodiment 1.

Referring to FIG. 5, the connection portion 4 includes an inserting block 41 and a spring 42. The inserting block 41 is slidably connected to the end of the connection block 221. A mounting chamber 2211 is provided in the connection block 221. The spring 42 is mounted in the mounting chamber 2211. The end of the spring 42 abuts against a part of the inserting block 41 that is located in the mounting chamber 2211, and the spring 42 forces the inserting block 41 to protrude out of the mounting chamber 2211. It should be understood that the two ends of the connection block 221 are both provided with the connection portion 4. Therefore, two ends of the spring 42 respectively abut against the inserting blocks 41 on two ends.

It should be noted that, the arrangement of the groove 225 narrows the mounting chamber 2211 of the connection block 221. The narrowed mounting chamber 2211 can reduce the risk of the excessive deformation and displacement of the spring 42 in the mounting chamber.

Referring to FIG. 1, FIG. 3 and FIG. 5, an inserting hole 2115 is provided on the sidewall of the ring member 211. The inserting block 41 is configured to insert in the inserting hole 2115. A notch 2116 is provided on the periphery of the ring member 211. The notch 2116 is communicated with the inserting hole 2115. In order to clarify the position of the notch 2116, an axis of the inserting hole 2115 is taken as a boundary, the notch 2116 and the lifting belt 3 are respectively positioned on two sides of the inserting hole 2115. An internal wall of the ring member 211 corresponding to the notch 2116 is configured to be inclined to form a sliding surface for guiding the inserting block 41 inserting into the inserting hole 2115, so that the efficiency that inserting the inserting block 41 in the inserting hole 2115 is improved in the situation of a restricted view.

Referring to FIG. 3, FIG. 4, and FIG. 5, the linkage member 224 includes an elastic plate 2241 and a connection cord 2242. One end of the elastic plate 2241 is connected to one clamping block 222, and the other end thereof is connected to the other clamping block 222 bypassing the connection block 221. The part of the elastic plate 2241 bypassing the connection block 221 is positioned in the groove 225. A cord hole 2212 is provided on the bottom of the groove 225 of the connection block 221. The cord hole 2212 is communicated with the mounting chamber 2211. The connection cord 2242 is configured to pass through the cord hole 2212. Two ends of the connection cord 2242 are respectively connected to the inserting blocks 41 on two ends of the connection block 221. The middle part of the connection cord 2242 passes through the cord hole 2212 and is connected to the elastic plate 2241. When pinching two clamping blocks 222, the elastic plate 2241 is deformed to protrude. The inserting block 41 is disengaged from the inserting hole 2115 by pulling the connection cord 2242. The connection block 221 can be disengaged from the ring member 211 by pinching two clamping blocks 222.

The implementation principle of Embodiment 1 is: two clamping blocks 222 are pinched before mounting the shoelace in the traction mechanism 2. The shoelace is placed on the connection block 221 and the clamping blocks 222. After determining the exposed length of the shoelace, the connection block 221 passes through the connection gap to a determined position, and two clamping blocks 222 are released, so that the inserting block 221 is inserted in the ring member 211 and the shoelace pass through two shoelace holes. In addition, the exposed length of the shoelace is determined before mounting the shoelace in the shoelace holes. The shoelace can be settled in one step when mounting the tightness adjusting device on the shoelace in the factory or by the customer, which improves the factory assembly efficiency and using experience of the customers. It is convenient for the customer to wash the shoelace or replace the shoelace that passes through the traction assembly 21, simplifying the operation of mounting the shoelace in the traction mechanism 2 and facilitating adjusting the tightness.

Embodiment 2

Figure 6:
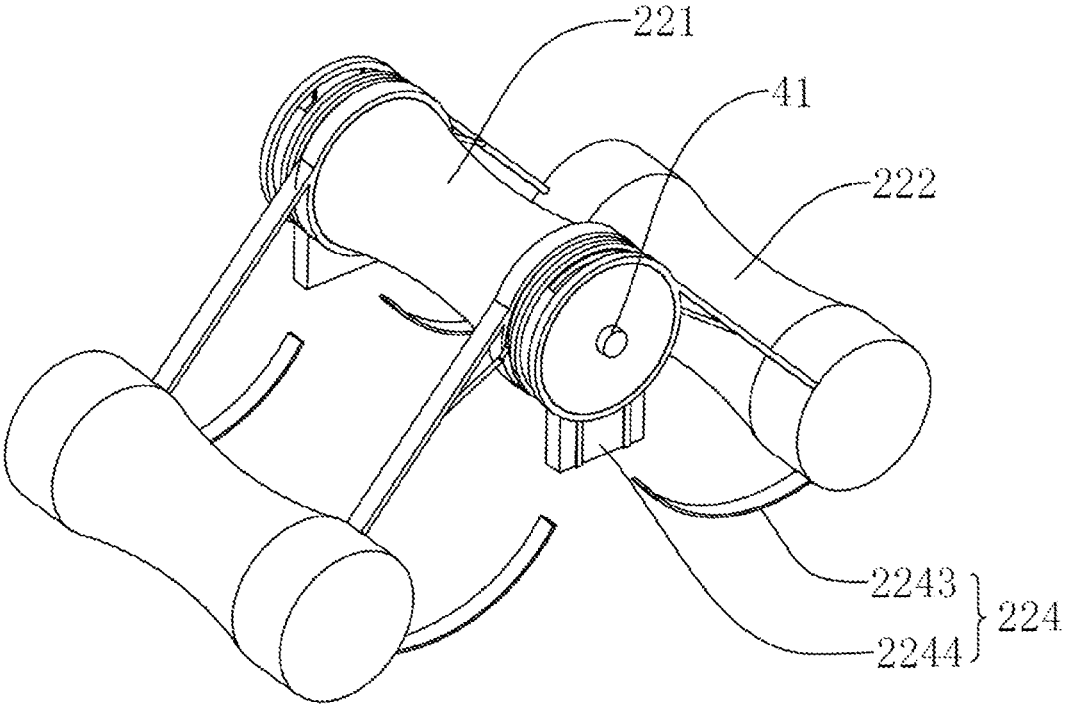
FIG. 6 is a schematic diagram for indicating a structure of a linkage member in Embodiment 2.
Figure 7:
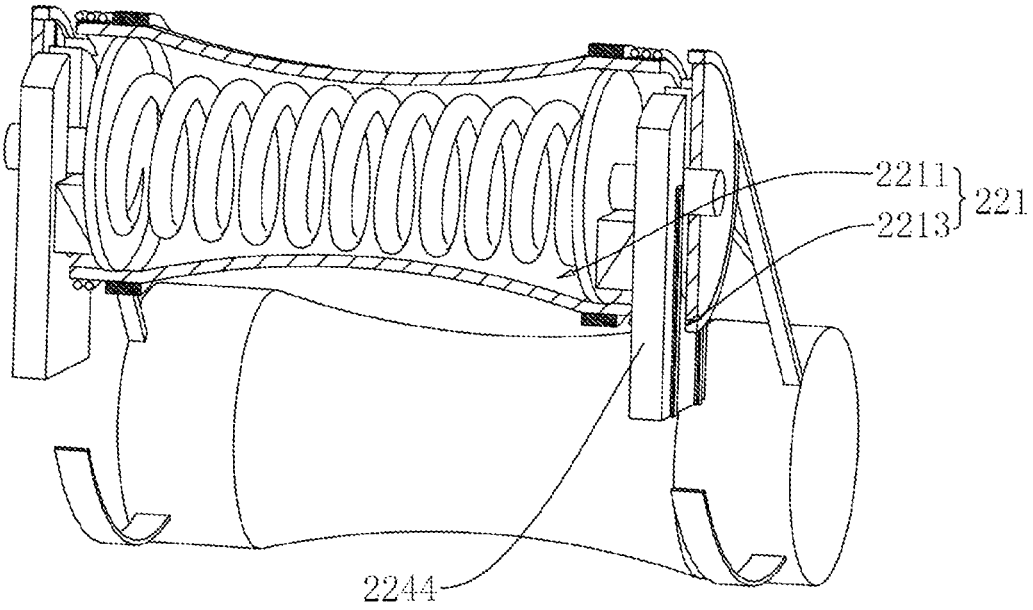
FIG. 7 is a schematic diagram for indicating a state of a trigger plate mounted in a connection block in Embodiment 2.

Referring to FIG. 6 and FIG. 7, this embodiment differs from Embodiment 1 in that: the linkage member 224 includes an abutting rod 2243 and a trigger plate 2244. The abutting rod 2243 is connected to the clamping block 222. An end of the abutting rod 2243 away from the clamping block 222 abuts against the trigger plate 2244. The trigger plate 2244 is slidably connected to the connection block 221. A moving direction of the trigger plate 2244 is perpendicular to a moving direction of the inserting block 41. A moving hole 2213 is provided on the sidewall of the connection block 221, and a part of the trigger plate 2244 is extended out of the moving hole 2213.

Figure 8:
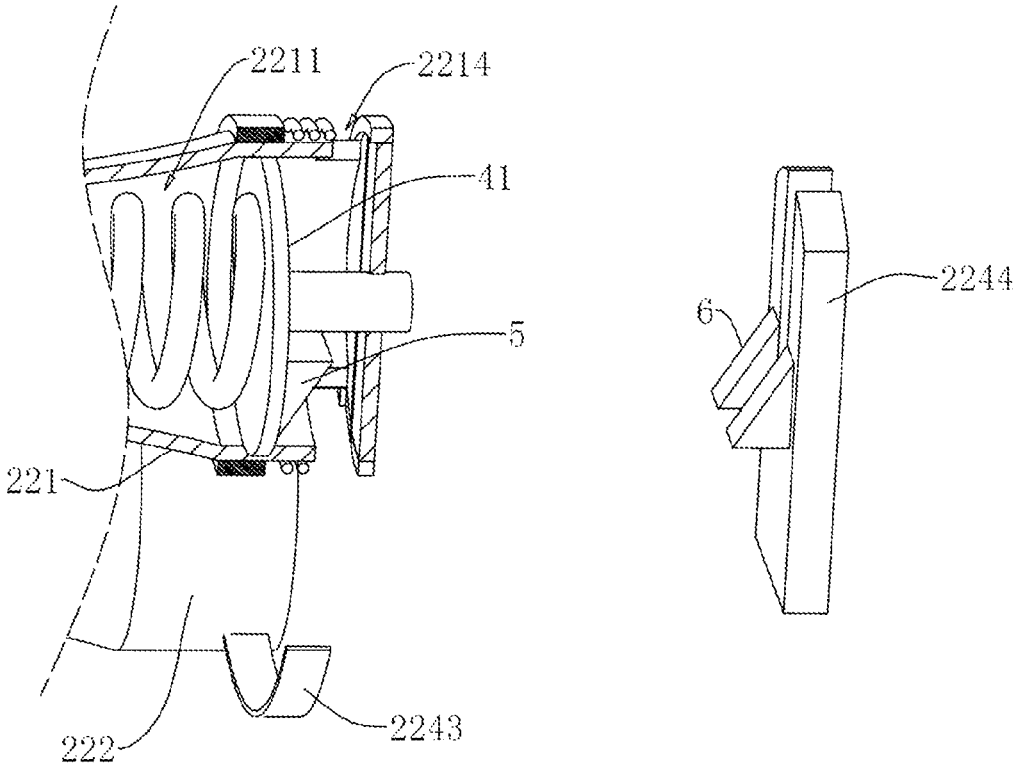
FIG. 8 is schematic diagram for indicating mounting positions of a first guiding block and a second guiding block in Embodiment 2.

Referring to FIG. 3 and FIG. 8, a first guiding block 5 is provided in the part of the inserting block 41 that positioned in the mounting chamber 2211. A second guiding block 6 is provided in the part of the trigger plate 2244 that positioned in the mounting chamber 2211. The second guiding block 6 is configured to abut against the first guiding block 5. When pinching two clamping blocks 222, the abutting rod 2243 abuts against the part of the trigger plate 2244 that extends out of the mounting chamber 2211, so as to drive the trigger plate 2244 to move. The trigger plate 2244 forces the inserting block 41 disengaging from the ring member 211 by the first guiding block 5 and the second guiding block 6.

The implementation principle of Embodiment 2: by using the displacement when pinching two clamping blocks 222 in combination with the abutting rod 2243, the trigger plate 2244 can force the inserting block 41 disengaging from the ring member 211 by the first guiding block 5 and the second guiding block 6, reducing the risk that the inserting block 41 cannot be disengaged from the ring member 211 due to the entrance of the external impurities in the inserting hole 2115. Further, the trigger plate 2244 can be directly pressed, so that the inserting block 41 is directly disengaged from the ring member 211 without pinching two clamping blocks 222, providing a redundant design for the disengagement of the inserting block 41 from the ring member 211, and ensuring the disengagement of the inserting block 41 from the ring member 211.

Embodiment 3

Figure 9:
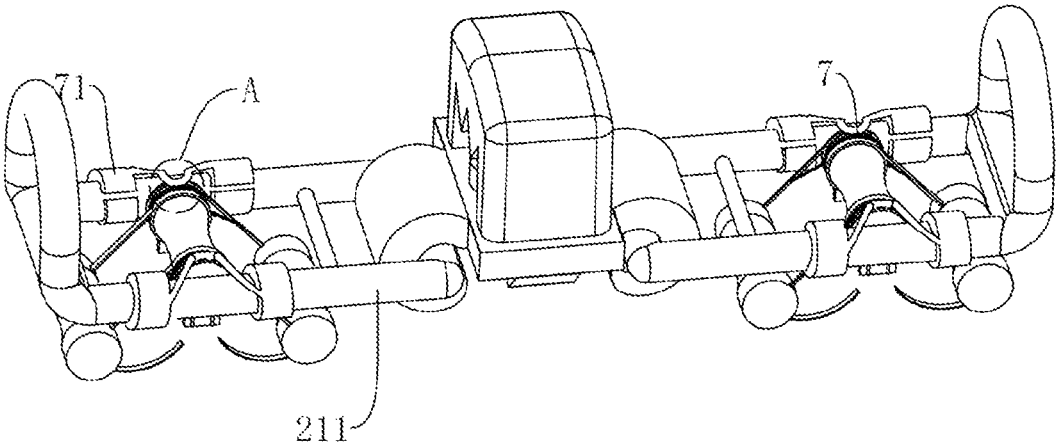
FIG. 9 is a schematic diagram for indicating a limiting member in a state of mounting in a ring member in Embodiment 3.

Referring to FIG. 8 and FIG. 9, this embodiment differs from Embodiment 2 in that: a limiting hole 2214 for the trigger plate 2244 to pass through is provided on the sidewall of the connection block 221. The limiting hole 2214 is corresponding to the moving hole 2213. A limiting member 7 is detachably connected to the connection block 221. The limiting member 7 is configured to block the limiting hole 2214 and reduce a risk that the connection block 221 is disengaged from the ring member 211 due to the movement of the trigger plate 2244.

Figure 10:
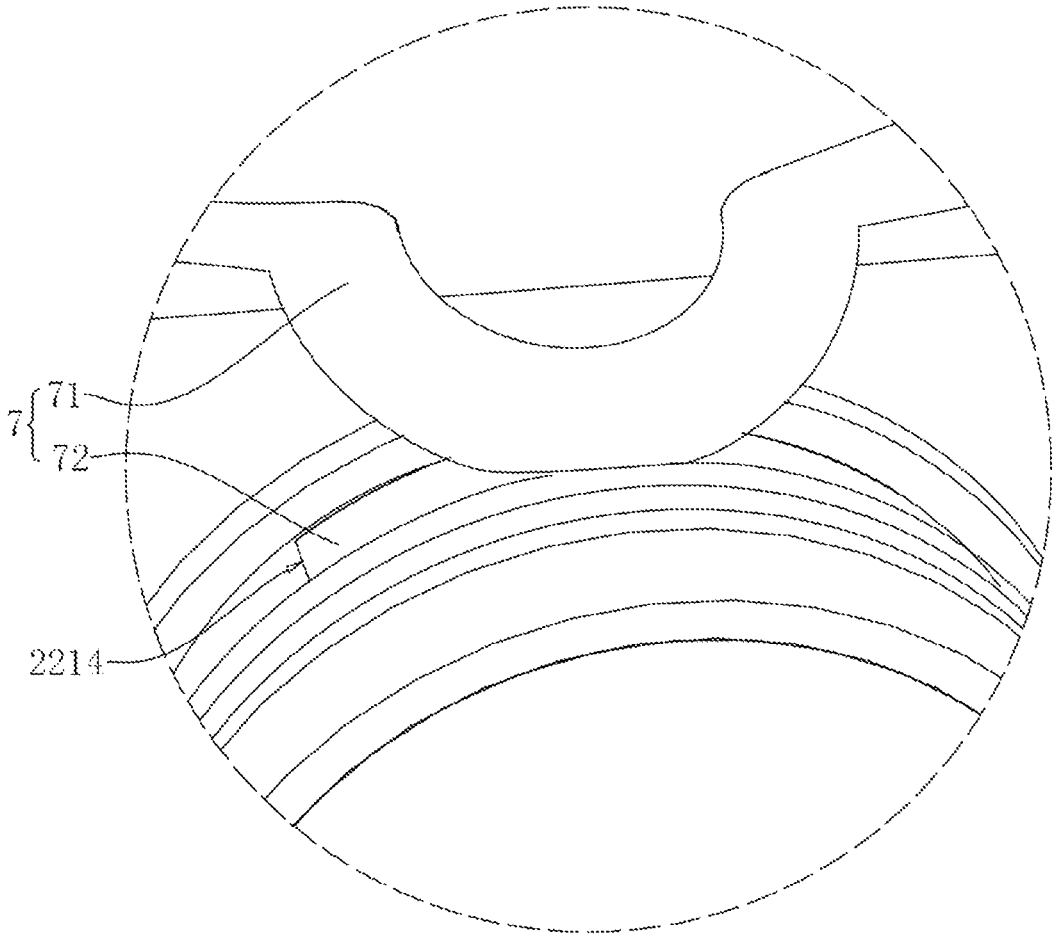
FIG. 10 is an enlarged schematic diagram of portion A in FIG. 9.

Referring to FIG. 9 and FIG. 10, the limiting member 7 includes a spring 71 and a plugging block 72. There are two springs 71. Two springs are respectively connected to two ends of the connection block 221. Two ends of the spring 71 is sleeved around a periphery of the ring member 211. The spring 71 can be understood as a torsion spring. The plugging block 72 is mounted in the middle of the spring 71, and the spring 71 is configured to force the plugging block 72 inserting in the limiting hole 2214.

Embodiment 4

Figure 11:
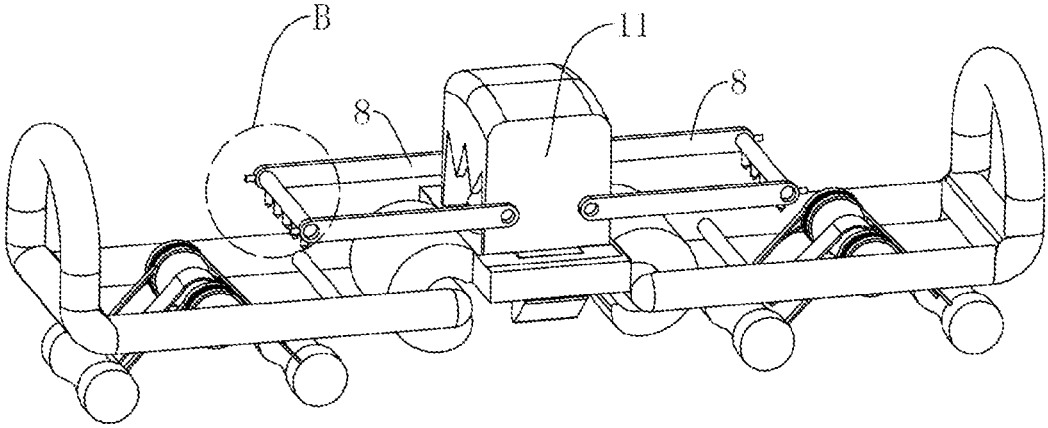
FIG. 11 is a schematic diagram for indicating an overall structure in Embodiment 4.
Figure 12:
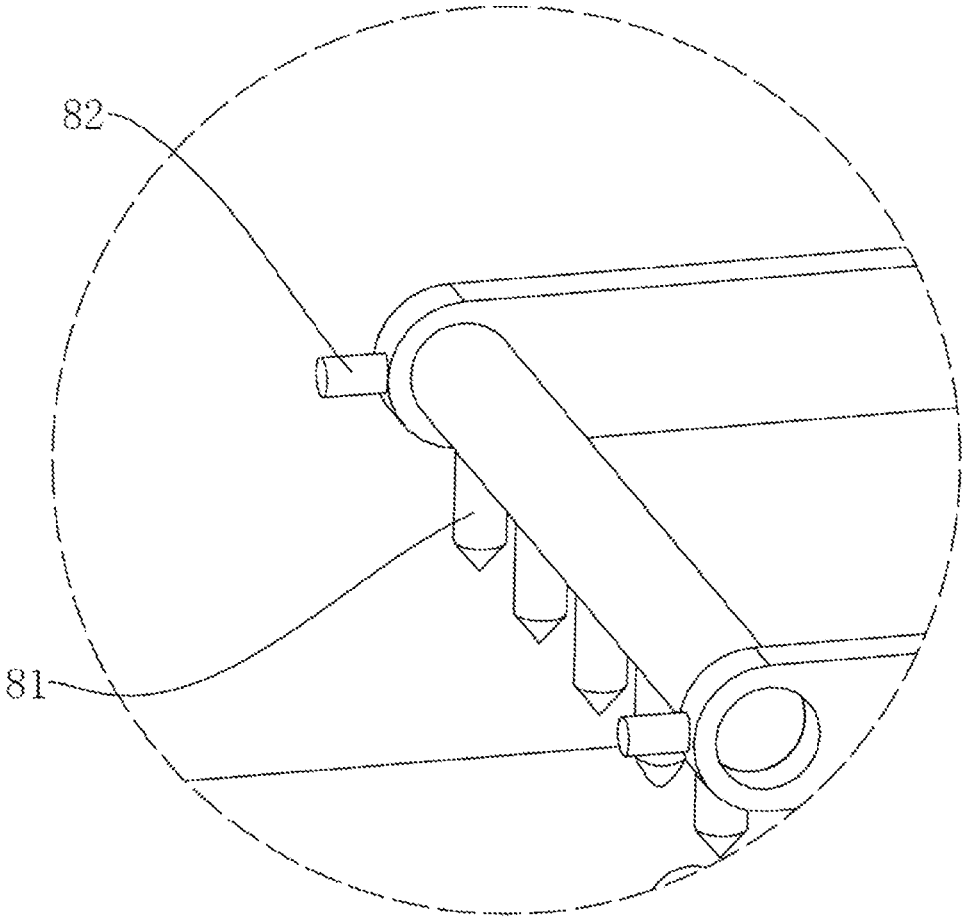
FIG. 12 is an enlarged schematic diagram of portion B in FIG. 11.

Referring to FIG. 1, FIG. 11 and FIG. 12, this embodiment differs from Embodiment 1 in that: a swing rod 8 is hinged with the sidewall of the fixed cover 11. Sharp pins 81 are provided on a periphery of the swing rod 8. A weight block 82 is provided in the swing rod 8, and the weight block 82 is configured to force the sharp pins 81 piercing the shoelace. The swing rod 8 is adhesively connected to the lifting belt 3. When two traction assembly 21 are on the same plane, the lifting belt 3 drives the swing rod 8 to disengage from the shoelace, so that the sharp pins 81 are disengaged from the shoelace.

The implementation principle of Embodiment 4 is: the swing rod 8 and the sharp pins 81 realize stabilizing the position of the shoelace in the shoelace holes. When adjusting the tightness of the shoelace, two traction assemblies 21 are moved to the same plane by using the lifting belt 3, so that the swing rod 8 is disengaged from the shoelace by the lifting belt 3, and the sharp pins 81 are disengaged from the shoelace, so as to adjust the tightness by pulling the shoelace.

The above are the preferred embodiments of the present application, which are not intended to limit the protection scope of the present application. Therefore, all equivalent changes made according to the structure, shape and principle of the present application should be covered within the protection scope of the present application.

What is claimed is:

1. A tightness adjusting device for a shoelace comprising: a connection mechanism and a traction mechanism, wherein the traction mechanism comprises a traction assembly, the traction assembly comprises a ring member hinged with the connection mechanism, and the traction mechanism further comprises an elastic adjusting assembly;

the elastic adjusting assembly comprises a connection block, two clamping blocks, an elastic member and a linkage member, a connection portion is connected to each of two ends of the connection block, the connection portion is detachably connected to the ring member, the connection block divides the ring member into two shoelace holes for accommodating shoelaces, each of the two clamping blocks is hinged with the connection block, the elastic member is connected among the connection block and the two clamping blocks, the elastic member is configured to keep the two clamping blocks away from each other, each of the two clamping blocks is connected to the connection portion by the linkage member, and the linkage member is configured to disengage the connection portion from the ring member when the two clamping blocks are pinched to abut against each other.

2. The tightness adjusting device for the shoelace according to claim 1, wherein the connection portion comprises an inserting block and a first spring, the inserting block is slidably connected to the connection block, a mounting chamber is provided in the connection block, the first spring is mounted in the mounting chamber, an end of the first spring abuts against a portion of the inserting block located in the mounting chamber to keep the inserting block protruding out of the mounting chamber, an inserting hole is provided on a sidewall of the ring member, and the inserting block is configured to insert into the inserting hole.

3. The tightness adjusting device for the shoelace according to claim 2, wherein the linkage member comprises an elastic plate and a connection cord, a first end of the elastic plate is connected to one clamping block of the two clamping blocks and a second end of the elastic plate is connected to a second clamping block of the two clamping blocks bypassing the connection block, the elastic plate is connected to the inserting block by the connection cord, when pinching the two clamping blocks, the elastic plate is deformed to protrude, and the inserting block is disengaged from the inserting hole by a pull force of the connection cord.

4. The tightness adjusting device for the shoelace according to claim 2, wherein the linkage member comprises an abutting rod and a trigger plate, the abutting rod is provided in the two clamping blocks, an end of the abutting rod away from the two clamping blocks is configured to abut against the trigger plate, the trigger plate is slidably connected to the connection block, a moving direction of the trigger plate is perpendicular to a moving direction of the inserting block, a moving hole is provided on a sidewall of the connection block, a part of the trigger plate extends out of the moving hole, a first guiding block is provided in a part of the inserting block that is located in the mounting chamber, a second guiding block is provided in a part of the trigger plate that is located in the mounting chamber, the second guiding block is configured to abut against the first guiding block, when pinching the two clamping blocks, the abutting rod abuts against a part of the trigger plate that extends out of the mounting chamber and drives the trigger plate to move, the trigger plate forces the inserting block to disengage from the ring member by the first guiding block and the second guiding block.

5. The tightness adjusting device for the shoelace according to claim 4, wherein a limiting hole for the trigger plate to pass through is defined in the sidewall of the connection block, the limiting hole corresponds to the moving hole, a limiting member is detachably connected to the connection block, the limiting member is configured to block the limiting hole and limit movement of the trigger plate.

6. The tightness adjusting device for the shoelace according to claim 5, wherein the limiting member comprises a second spring and a plugging block, two ends of the second spring are sleeved around a periphery of the ring member, the plugging block is mounted in a middle of the second spring, and the second spring is configured to force the plugging block to be inserted into the limiting hole.

7. The tightness adjusting device for the shoelace according to claim 2, wherein a notch is provided in the ring member, the notch is in communication with the inserting hole, and an internal wall of the ring member corresponding to the notch is configured to be inclined to form a sliding surface for guiding the inserting block to be inserted into the inserting hole.

8. The tightness adjusting device for the shoelace according to claim 1, wherein a groove is defined in the connection block, and the groove is arranged along a circumference of the connection block for accommodating the shoelace.

9. The tightness adjusting device for the shoelace according to claim 1, wherein a swing rod is hinged with the connection mechanism, a pin is provided in the swing rod, the pin is configured to pierce the shoelace, a lifting belt connected to the swing rod is provided in the connection mechanism, the lifting belt is configured to lift the traction assembly, when two traction assemblies are on a same plane, the lifting belt lifts the swing rod to disengage from the shoelace, so that the pin is disengaged from the shoelace.

10. The tightness adjusting device for the shoelace according to claim 9, wherein a weight block is provided in the swing rod, and the weight block is configured to force the pin to pierce the shoelace.

* * * * *